United States Patent [19]

Trotta

[11] 4,403,413

[45] Sep. 13, 1983

[54] SHAVING IMPLEMENT

[75] Inventor: Robert A. Trotta, Winthrop, Mass.

[73] Assignee: The Gillette Company, Boston, Mass.

[21] Appl. No.: 300,400

[22] Filed: Sep. 11, 1981

Related U.S. Application Data

[63] Continuation-in-part of Ser. No. 194,551, Oct. 6, 1980, Pat. No. 4,354,312.

[51] Int. Cl.[3] ..... B26B 21/06; B26B 21/22

[52] U.S. Cl. ..... 30/47; 30/50

[58] Field of Search ..... 30/47, 50, 52, 68

[56] References Cited

U.S. PATENT DOCUMENTS

| | | | |
|---|---|---|---|
| 2,729,887 | 1/1956 | Appeldorn | 30/47 X |
| 2,794,246 | 6/1957 | Marsh | 30/47 X |
| 2,799,927 | 7/1957 | Beham | 30/47 |
| 3,388,831 | 6/1968 | Hansom | 221/220 |
| 3,852,883 | 12/1974 | Ferraro | 30/50 |
| 3,955,277 | 5/1976 | Pomfret | 30/50 |
| 4,069,580 | 1/1978 | Cartwright | 30/47 |
| 4,245,388 | 1/1981 | Dawidowicz | 30/47 |
| 4,245,389 | 1/1981 | Trotta | 30/47 |

FOREIGN PATENT DOCUMENTS

| | | |
|---|---|---|
| 54-2775 | 2/1979 | Japan . |
| 55-30450 | 7/1980 | Japan . |
| 56-46698 | 10/1981 | Japan . |

*Primary Examiner*—Jimmy C. Peters

*Attorney, Agent, or Firm*—Scott R. Foster

[57] ABSTRACT

A shaving implement including a platform portion, a back portion, a cap portion overlying the platform portion, the platform, back, and cap portions being an integrally molded plastic unit, and a blade means permanently disposed between the cap and platform portions, the cap portion exercising a clamping pressure on the blade means.

3 Claims, 5 Drawing Figures

SHAVING IMPLEMENT

CROSS-REFERENCE TO RELATED APPLICATION

This is a continuation-in-part of application Ser. No. 194,551, filed Oct. 6, 1980, U.S. Pat. No. 4,354,312 in the name of Robert A Trotta.

BACKGROUND OF THE INVENTION

1. Field of the Invention

The invention relates to wet shaving systems and is directed more particularly to a low-cost highly maneuverable wet shaving device.

2. Description of the Prior Art

It is generally known in the art to provide a housing having platform and cap portions adapted to receive a blade means therebetween. In U.S. Pat. No. 1,195,259, issued Aug. 22, 1916 to W. E. O'Reilly, there is shown a platform and cap portion formed from a single piece of metal, the cap overlying the platform.

It is also generally known to embed a blade in a plastic shaving head, the head being permanently attached to a handle, or alternatively, removable from a handle for replacement by another shaving head. U.S. Pat. No. 1,864,995, issued June 28, 1932 to T. H. Frost shows such an arrangement.

More recent examples of plastic shaving heads having blades fixed therein include U.S. Pat. No. 3,703,764, issued Nov. 28, 1972 to Roger L. Perry, U.S. Pat. No. 3,724,070 issued Apr. 3, 1973 to Francis W. Dorion, and U.S. Pat. No. 4,026,016 issued May 31, 1977 to Warren I. Nissen. While such recent examples have been eminently successful, there is, as always, a need for such products which are less expensive to manufacture and offer improved functional characteristics.

A combination of the simplicity of the O'Reilly device and the more recent blade-in-plastic shaving implements would afford significant cost savings, and at the same time permit manufacture of a more maneuverable, more easily handled shaving implement.

Recognizing that it is only the cutting edge of a razor blade that does a razor's work, there have been attempts to use narrower blades. In most cartridge-type shaving units blades are retained in plastic cartridges by the passing of plastic posts, or pins, through holes in the blades and heading over the posts. While such method has successfully accomplished its goal, the use of "rivets" of this sort requires a blade of a width of about 1/10 inch, limiting to a great extent the degree of narrowness possible. Efforts have been made, as described in U.S. Pat. No. 4,084,316, issued Apr. 18, 1978, to John F. Francis, to utilize very narrow blades by way of welding the blades to a support, such as a rigid wire. Welding presents problems by virtue of the heat required and the effect of such heat on the blade metal.

Accordingly, there exists a need for a shaving implement construction which will permit use of blades narrower than 1/10 inch but not such as to subject the blades to harmful temperatures, or other deleterious conditions, during fabrication.

SUMMARY OF THE INVENTION

It is therefore an object of the present invention to provide a shaving implement including blade means disposed between cap and platform portions which operate to retain the blade means without need of rivet portions, or the like.

A further object of the invention is to provide a shaving implement utilizing narrow blade means disposed between the cap and platform portions and retained therebetween.

With the above and other objects in view, as will hereinafter appear, a feature of the present invention is the provision of a shaving implement comprising a platform portion, a back portion upstanding from a lengthwise margin of the platform portion, a cap portion extending from the back portion and overlying the platform portion, the platform, back, and cap portions being an integrally molded plastic unit, and blade means permanently disposed between the cap and platform portions, the cap portion being adapted to exercise a clamping pressure on the blade means, the blade means comprising a first blade member, a spacer, and a second blade member, the blade and spacer members being in abutting engagement and adapted to be held together by the clamping pressure, but otherwise being unconnected, the spacer having lugs and the platform having leaf spring members adapted to snap into locking engagement with the lugs to lock the blade means in place.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENTS

Figure 1:
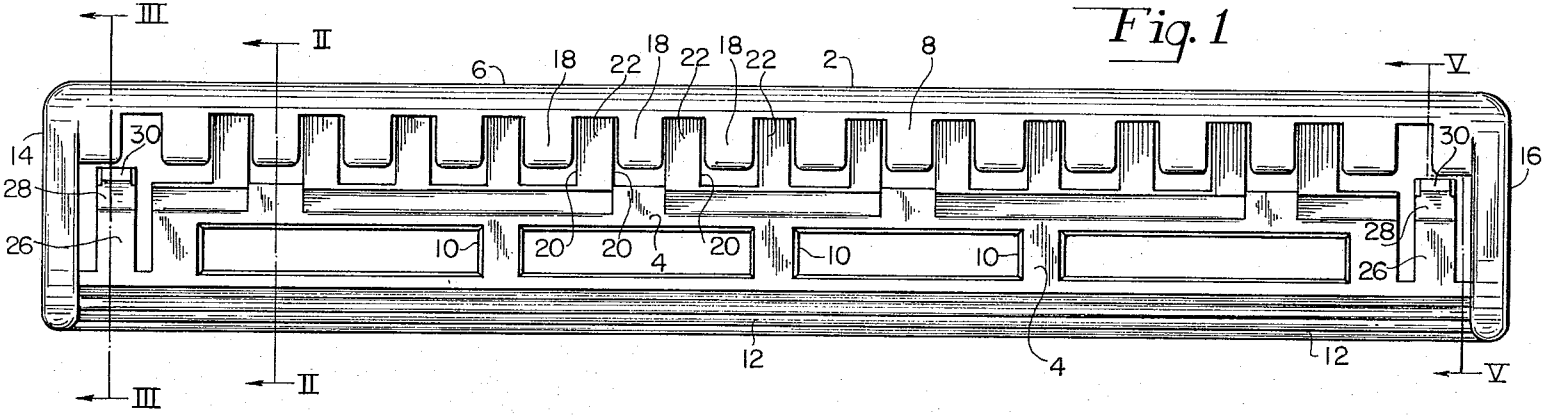
FIG. 1 is a top plan view of a housing suitable for use in an illustrative embodiment of the invention.
Figure 3:
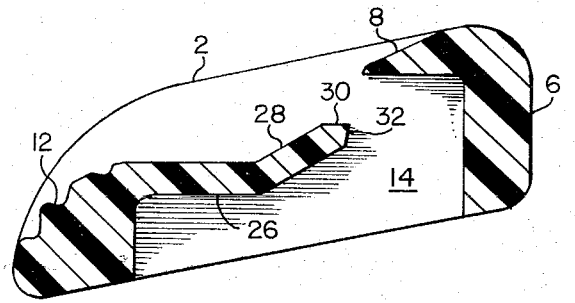
FIGS. 2 and 3 are sectional views taken along lines II—II and III—III, respectively.
Figure 2:
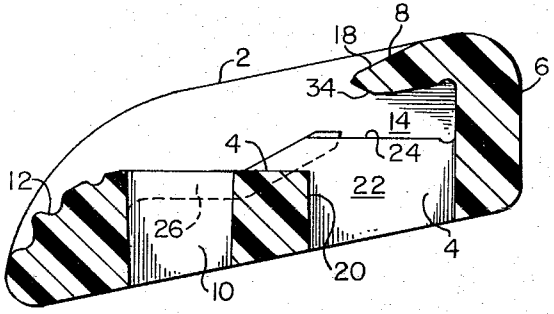

Referring to the drawings, and particularly FIGS. 1–3, it will be seen that an illustrative housing 2 includes a platform portion 4. A back portion 6 upstands from a lengthwise margin of the platform portion 4, and a cap portion 8 extends forwardly from the back portion 6 to overlie the platform portion. The housing further includes leg portions 10 extending forwardly from the platform portion and joining a guard portion 12 which is disposed parallel to the back portion 6. The housing is further provided with end walls 14, 16 interconnecting the back and guard portions at the ends of the housing.

The cap portion 8 in an unstressed state (FIG. 2) is adapted to incline toward the platform portion 4 to a first position. The cap portion is sufficiently flexible to receive a blade means therebeneath, the blade means stressing the cap portion to a second position (FIG. 5) further removed from the platform portion than the first position. The cap portion thereby exercises a clamping pressure on the blade means.

The cap portion 8 may comprise a series of spaced, aligned, forwardly extending fingers 18. The platform portion may be provided with a series of spaced, aligned recesses 20, the recesses being separated by platform rib portions 22. As may be seen in FIG. 1, each of the fingers 18 is disposed over one of the recesses 20 and each of the rib portions 22 is in alignment with a space between two of the fingers 18.

Preferably, the entire housing, and at least the platform, back, and cap portions, is of molded plastic and is molded as an integral unit. The fingers 18 are in effect leaf springs adapted to flex to receive a blade means between the fingers and the platform and further serve to urge the blade means against an upper surface 24 of the platform portion.

In a preferred embodiment, the guard portion 12 is provided with rearwardly-extending leaf spring members 26 molded integrally with the guard portion 12. The free ends of the leaf spring members 26 are each provided with an inclined cam surface 28, an upper surface 30, and a rearward surface 32, the latter being generally normal to the upper surface 30 (FIG. 3).

Each of the fingers 18 include a guide surface 34, (FIG. 2), serving to guide a blade means into the gap, or pocket, formed by the platform and back portion and the fingers. As noted above, the fingers 18 are formed such that while extending forwardly, the fingers also extend slightly downwardly, as viewed in FIG. 2, or toward the platform surface 24.

Figure 4:
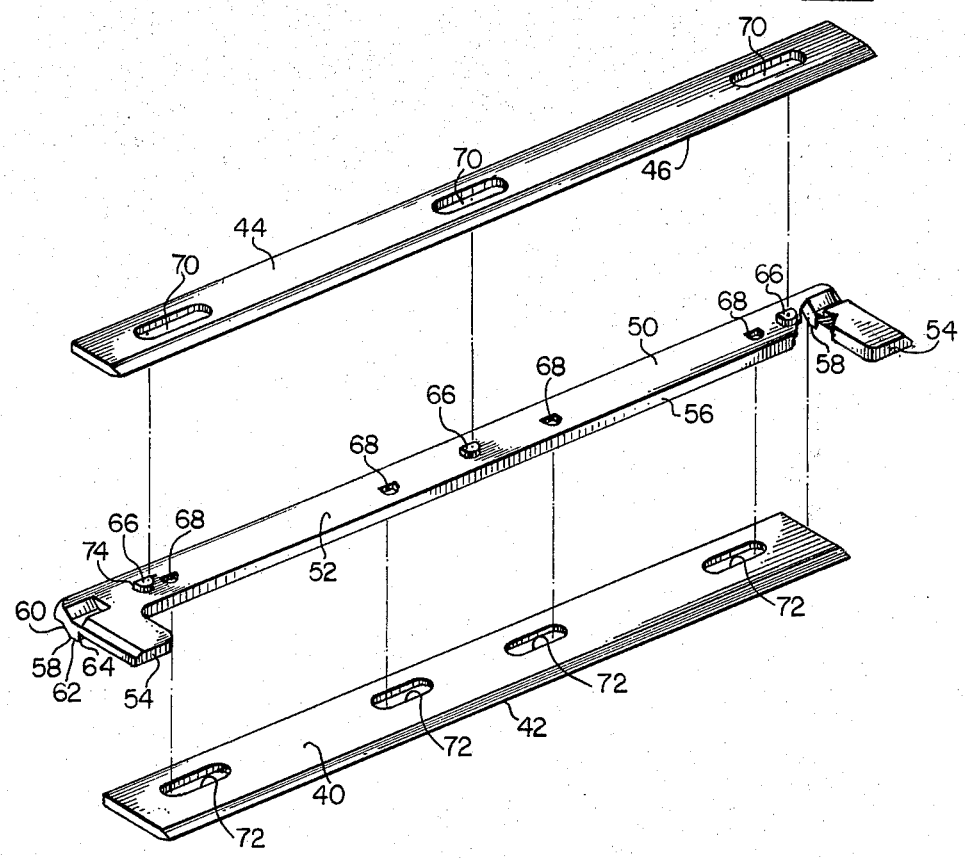
FIG. 4 is an exploded perspective view of an illustrative blade means.

Referring to FIG. 4, it will be seen that a blade means suitable for use with the above-described housing includes a first blade 40 having a cutting edge 42 and a narrower second blade 44 having a cutting edge 46, the blades 40, 44 being disposed on either side, respectively, of a spacer member 50. The spacer member 50 includes an elongated central portion 52 and end portions 54 extending forwardly of a frontal edge 56 of the central portion 52. The spacer member 50 is further provided with lugs 58 extending from the underside thereof, the lugs 58 being aligned with and engageable with the aforementioned leaf spring members 26. Each of the lugs 58 is provided with an inclined cam surface 60, a bottom surface 62, and a trailing surface 64, the latter being generally normal to the bottom surface 62.

Preferably, the spacer member 50 is further provided with upper and lower detents, 66, 68 extending, respectively, from the upper and under surfaces of the spacer member. The upper detents 66 are received by holes 70 in the second blade member 44 and the lower detents 68 are similarly received by apertures 72 in the first blade member 40. Each detent 66, 68 is provided with a rearwardly-facing surface 74 substantially normal to the plane of the spacer member 50, the surface 74 being engageable with the rearward wall of its respective hole 70 or aperture 72.

Figure 5:
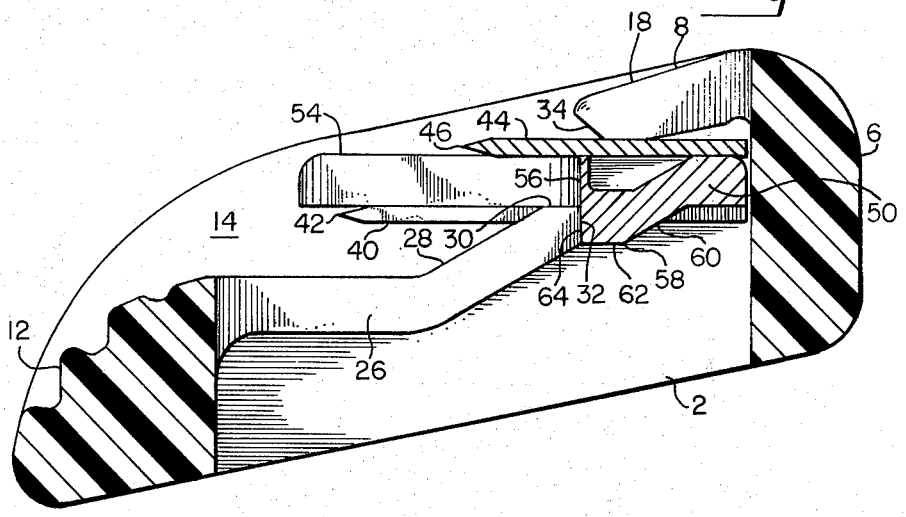
FIG. 5 is a sectional view taken along line V—V of FIG. 1, but showing the blade means and housing combined in one form of shaving implement illustrative of an embodiment of the invention.

In assembly, the blade means including the first blade 40, spacer 50, and second blade 44, is inserted between the fingers 18 and the upper surfaces 24 of the rib portions 22, the finger guide surfaces 34 guiding and urging the blade means into place. As the assembly of first and second blades 40, 44 is moved into place, the surfaces 74 of the detents 66, 68 engage the rearward walls of the holes 70 and apertures 72 in which they are disposed, causing the assembly to move into place in proper alignment, the spacer acting as a carrier for the blade members. As the blade assembly moves into place, the lugs 58 engage the leaf spring members 26, the cam surfaces 60 engaging the cam surfaces 28, to deflect the leaf spring members downwardly. Continued pressure on the blade means causes the lugs 58 to override the leaf spring member 26, with the surfaces 30, 62 sliding along each other until the leaf spring member snaps upwardly to lock the lugs 58, and thereby the blade means, in place, the spring surface 32 coming to rest adjacent the lug surface 64, as seen in FIG. 5.

The blade and spacer portions of the blade means are retained in position relative to each other by the pressure thereon exercised by the cap portion 8 and the above-described spring and detent means, and are otherwise not attached to each other. There being no rivet connecting means, it will be apparent that the width of the blade is not a critical factor and a very narrow blade, less than 1/10 inch from the cutting edge to rearward edge, may be used.

It will be apparent to those skilled in the art that the housing may be provided with means (not shown) for attachment to a razor handle. Such means may comprise the well known groove means disclosed in the aforementioned U.S. Pat. No. 3,724,070, or journal bearing means as disclosed in the aforementioned U.S. Pat. No. 4,026,016. Alternatively, a handle may be of the type permanently connected to the housing 2, rather than of the type selectively connected and disconnected to and from the housing.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A shaving implement comprising a platform portion, a back portion upstanding from a lengthwise margin of said platform portion, a cap portion extending from said back portion and overlying said platform portion, and blade means adapted to be permanently disposed between said cap and platform portions, said cap portion being adapted to exercise a clamping pressure on said blade means, said blade means comprising a first blade member, a spacer member, and a second blade member, said spacer member being disposed between said first and second blade members, said blade and spacer members being in abutting engagement and adapted to be held together by said clamping pressure, but otherwise being unconnected, said spacer having a lug extending from its underside proximate either end thereof, and said platform portion having a pair of integrally molded leaf spring members sufficiently flexible to permit said lugs to ride thereover during insertion of said blade means between said platform and cap portions, but biased to thereafter snap into locking engagement with said lugs to lock said spacer permanently in said disposition between said platform and cap portions.

2. The invention in accordance with claim 1 in which said spacer is provided with upper and lower detents extending respectively from its upper and under surfaces, said first blade member is provided with apertures therein adapted to receive said lower detents, and said second blade member is provided with holes therein adapted to receive said upper detents.

3. The invention in accordance with claim 1 in which a guard portion is connected to said platform portion by leg portions extending forwardly from said platform portion, and said leaf spring members extend from said guard portion rearwardly toward said back portion.

* * * * *